US008977478B2

(12) United States Patent
Gebby et al.

(10) Patent No.: US 8,977,478 B2
(45) Date of Patent: Mar. 10, 2015

(54) METHOD OF SETTING A CONTROL PARAMETER FOR EMISSIONS ROBUSTNESS

(71) Applicants: Brian Gebby, Macomb, MI (US); Travis Hamilton, Westland, MI (US); Fadi S. Kanafani, Windsor (CA)

(72) Inventors: Brian Gebby, Macomb, MI (US); Travis Hamilton, Westland, MI (US); Fadi S. Kanafani, Windsor (CA)

(73) Assignee: Chrysler Group LLC, Auburn Hills, MI (US)

( * ) Notice: Subject to any disclaimer, the term of this patent is extended or adjusted under 35 U.S.C. 154(b) by 331 days.

(21) Appl. No.: 13/649,176

(22) Filed: Oct. 11, 2012

(65) Prior Publication Data

US 2013/0197788 A1 Aug. 1, 2013

Related U.S. Application Data

(60) Provisional application No. 61/552,484, filed on Oct. 28, 2011.

(51) Int. Cl.

| | |
|---|---|
| ***F02D 43/04*** | (2006.01) |
| ***F02D 41/14*** | (2006.01) |
| ***F02D 41/24*** | (2006.01) |
| *F02D 41/22* | (2006.01) |
| *F02D 41/00* | (2006.01) |

(52) U.S. Cl.

CPC ..... *F02D 43/04* (2013.01); *F02D 41/1454* (2013.01); *F02D 41/2432* (2013.01); *F02D 41/2451* (2013.01); *F02D 41/22* (2013.01); *F02D 2041/001* (2013.01); *F02D 2200/0402* (2013.01)

USPC ..... 701/113

(58) Field of Classification Search

USPC ..... 701/113, 102, 101, 115

See application file for complete search history.

(56) References Cited

U.S. PATENT DOCUMENTS

| | | | |
|---|---|---|---|
| 5,452,207 | A | 9/1995 | Hrovat et al. |
| 6,745,122 | B2 * | 6/2004 | Burgdorf et al. ..... 701/115 |
| 6,907,725 | B2 * | 6/2005 | Szymkowicz et al. ..... 60/285 |
| 8,245,569 | B2 * | 8/2012 | Ogiso et al. ..... 73/114.77 |
| 2003/0000488 | A1 | 1/2003 | Burgdorf et al. |
| 2007/0240695 | A1 | 10/2007 | Mitsuda et al. |

FOREIGN PATENT DOCUMENTS

| | | |
|---|---|---|
| EP | 2204566 A1 | 7/2010 |
| FR | 2923536 A3 | 5/2009 |

(Continued)

OTHER PUBLICATIONS

International Search Report for International Application No. PCT/US2012/060219, filed Oct. 15, 2012.

(Continued)

*Primary Examiner* — Hieu T Vo

(74) *Attorney, Agent, or Firm* — Ralph E Smith

(57) ABSTRACT

A method of verifying a default state of a control parameter in an automobile engine includes checking engine controller performance with the control parameter in both a default state and an alternate state. The results of the tests are then compared to verify which state is the appropriate state for the particular engine being tested. A third engine controller performance check can be made to ensure that the controller and engine perform in a repeatable manner prior to setting the state of the control parameter.

19 Claims, 4 Drawing Sheets

(56) References Cited

FOREIGN PATENT DOCUMENTS

| | | | | |
|---|---|---|---|---|
| JP | 63289266 A | * | 11/1988 | ..... F02P 5/15 |
| JP | 1100349 A | | 4/1989 | |

OTHER PUBLICATIONS

Written Opinion for International Application No. PCT/US2012/060219, filed Oct. 15, 2012.

* cited by examiner

METHOD OF SETTING A CONTROL PARAMETER FOR EMISSIONS ROBUSTNESS

CROSS REFERENCE TO RELATED APPLICATION

This invention claims the benefit of U.S. Provisional Ser. No. 61/552,484, filed Oct. 28, 2011

FIELD

The present disclosure relates to a method of verifying and setting control parameters in automobile engines and more particularly to a method of verifying the suitability of a default state of a control parameter for a particular engine to improve valve timing and emissions performance.

BACKGROUND

Modern automobile engines are generally controlled by a computerized system known as an Engine Control Unit (ECU). To configure the ECU, a single engine or small sample of engines are extensively tested on a dynamometer to establish default control settings for that model of engine. These default values are then applied to the ECUs that are incorporated into the thousands or even millions of subsequently manufactured engines of that model. Among other functions, the default values determine how the ECU will model air flow through the engine.

Many modern vehicles include a system that provides variable valve timing. While different systems exist, each type of system has the ability to alter the opening and closing of intake valves, exhaust valves, or both, to modify the air flow characteristics of the engine. This control over engine air flow allows the engines to run more efficiently and produce fewer emissions by maintaining a predetermined combustion level. In some circumstances the predetermined combustion level may represent optimal combustion conditions but this is not required. The ECU controls the variable valve timing system; therefore, the accuracy of the air flow modeling performed by the ECU is critical to the effective operation of the variable valve timing system.

During the initial dynamometer testing, a specific control parameter known as the mechanical-electrical confidence bit is set in the ECU. The mechanical-electrical confidence bit is assigned one of two possible logical states and represents a fundamental assumption that underlies the air flow modeling performed by the ECU. The first state assumes that the electrical system is perfect, thus all errors are coming from the mechanical system. The second state assumes that the mechanical system is perfect, thus all errors are coming from the electrical system. The ECU models the engine air flow differently depending upon the state of the mechanical-electrical confidence bit and the underlying assumption that the state implies.

Currently, the mechanical-electrical confidence bit is set as a result of the initial dynamometer tests. Such tests are used to determine a default state of the mechanical-electrical confidence bit, which is then applied to all subsequently manufactured engines. In some instances, however, this default state is not the appropriate mechanical-electrical confidence bit state for a particular subsequently manufactured engine. Unfortunately, the default state is used even though an alternate state would provide more accurate air flow modeling and improved performance. An alternate state is a state which is different from the default state. In the example of the mechanical-electrical confidence bit, the mechanical-electrical confidence bit has two values and thus the alternate state is different of the default state. Thus, it is desirable to test the appropriateness of the default state of the mechanical-electrical confidence bit for each engine manufactured and to change the mechanical-electrical confidence bit state when doing so would provide improved performance over the default state.

SUMMARY

In one form, the present disclosure provides a method of setting a control parameter in an automobile engine. The method includes inputting into an engine control unit a first set of data from a sensor while the control parameter is set to a default state and calculating a first value, based on the first set of data, indicative of a first level of correction required by the engine control unit to maintain a predetermined combustion level. Then the control parameter is changed from the default state to an alternate state and a second set of data is input in order to calculate a second value, based on the second set of data, indicative of a second level of correction required by the engine control unit to maintain the predetermined combustion level. Finally the first value and the second value are compared and the control parameter is set to either the default state or the alternate state based on the result of the comparison.

In another form, the present disclosure provides a method of setting a control parameter in an automobile engine. The method includes inputting into an engine control unit a first set of data from a sensor while the control parameter is set to a default state and calculating a first value, based on the first set of data, indicative of a first level of correction required by the engine control unit to maintain a predetermined combustion level. Then the control parameter is changed from the default state to an alternate state and a second set of data is input in order to calculate a second value, based on the second set of data, indicative of a second level of correction required by the engine control unit to maintain the predetermined combustion level. Next the control parameter is returned to the default state and third set of data is input and a third value calculated. This third value is then compared to the first value to ensure the engine and ECU behave in a repeatable manner. If the first and third values are not within an allowable variation of one another an error is reported. If the first and third values are sufficiently similar the first value and second value are compared and the control parameter state is set based on the result of the comparison.

In yet another form, the present disclosure provides an automobile engine that includes a plurality of cylinders, an exhaust manifold connected to the plurality of cylinders, at least one oxygen sensor located in the exhaust manifold, a variable valve timing system for controlling airflow through the engine, and an engine control unit. The ECU is configured to receive data from the at least one $O_2$ sensor to control the variable valve timing system to maintain a predetermined combustion level. The ECU is further configured to carry out a method of setting a control parameter. The method includes inputting into an engine control unit a first set of data from a sensor while the control parameter is set to a default state and calculating a first value, based on the first set of data, indicative of a first level of correction required by the engine control unit to maintain the predetermined combustion level. Then the control parameter is changed from the default state to an alternate state and a second set of data is input in order to calculate a second value, based on the second set of data, indicative of a second level of correction required by the engine control unit to maintain the predetermined combustion level. Finally the first value and the second value are compared and the control parameter is set to either the default state or the alternate state based on the result of the comparison.

In a further form, the present disclosure provides an automobile engine that includes a plurality of cylinders, an exhaust manifold connected to the plurality of cylinders, at least one oxygen sensor located in the exhaust manifold, a variable valve timing system for controlling airflow through the engine, and an engine control unit. The ECU is configured to receive data from the at least one $O_2$ sensor to control the variable valve timing system to maintain a predetermined combustion level. The ECU is further configured to carry out a method of setting a control parameter. The method includes inputting into an engine control unit a first set of data from a sensor while the control parameter is set to a default state and calculating a first value, based on the first set of data, indicative of a first level of correction required by the engine control unit to maintain the predetermined combustion level. Then the control parameter is changed from the default state to an alternate state and a second set of data is input in order to calculate a second value, based on the second set of data, indicative of a second level of correction required by the engine control unit to maintain the predetermined combustion level. Next the control parameter is returned to the default state and third set of data is input and a third value calculated. This third value is then compared to the first value to ensure the engine and ECU behave in a repeatable manner. If the first and third values are not within an allowable variation of one another an error is reported. If the first and third values are sufficiently similar the first value and second value are compared and the control parameter state is set based on the result of the comparison.

Further areas of applicability of the present disclosure will become apparent from the detailed description, drawings and claims provided hereinafter. It should be understood that the detailed description, including disclosed embodiments and drawings, are merely exemplary in nature, intended for purposes of illustration only, and are not intended to limit the scope of the invention, its application, or use. Thus, variations that do not depart from the gist of the invention are intended to be within the scope of the invention.

DETAILED DESCRIPTION

The inventors have realized that it is possible to test the appropriateness of the default state of a control parameter for each engine manufactured, even when installed in a completed vehicle, and to change the state of a control parameter if necessary. One example of a control parameter is the mechanical-electrical confidence bit which is discussed herein. Although the process is discussed in relation to the mechanical-electrical confidence bit, it is not limited thereto and can be applied to many different control parameters. Such a process is desirable as it ensures that the ECU in every vehicle manufactured will have the appropriate mechanical-electrical confidence bit state. The ECU having the appropriate mechanical-electrical confidence bit state results in more accurate air flow modeling by the ECU, which in turn improves control response time and engine performance while decreasing emissions.

Figure 1:
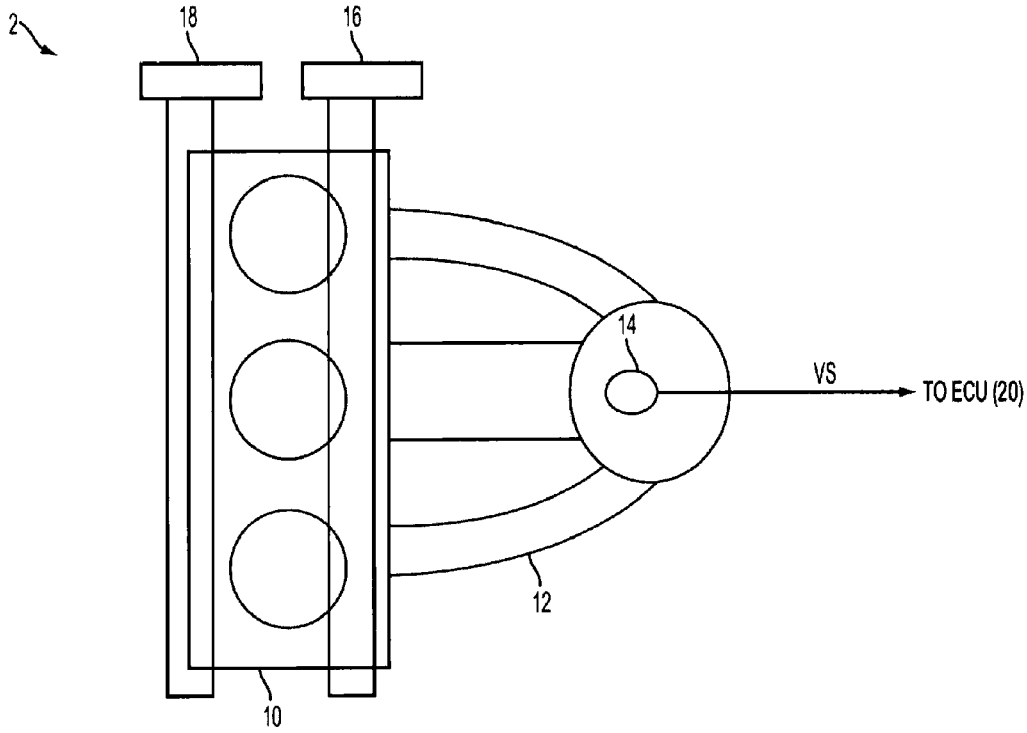
FIG. 1 illustrates an overhead view of a portion of an engine including intake and exhaust cam phasers and an exhaust manifold with an oxygen sensor.
Figure 2:
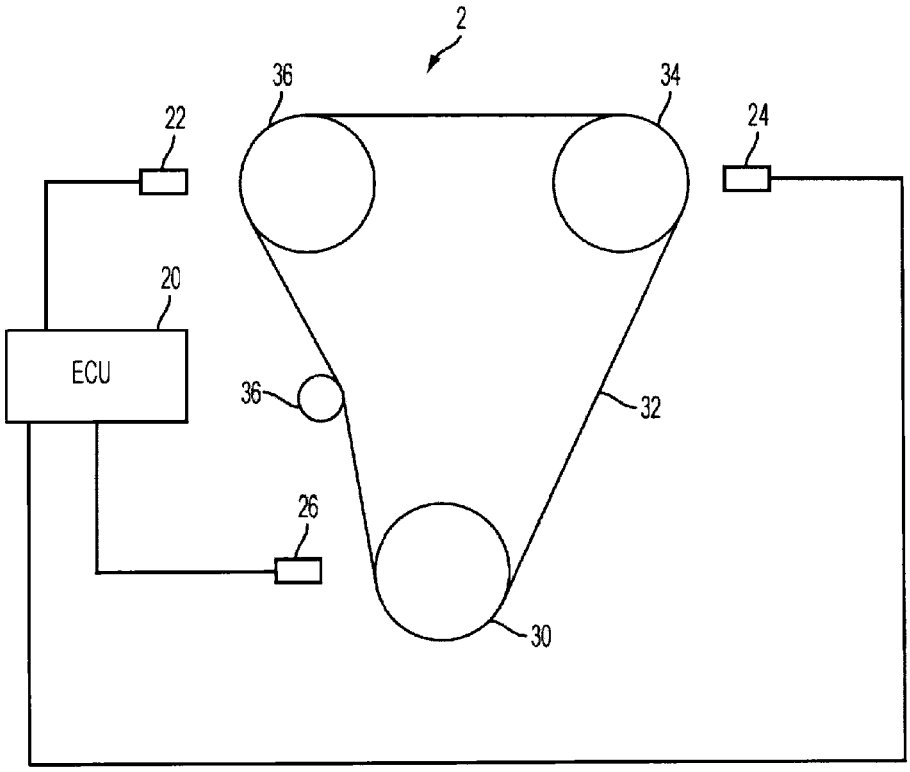
FIG. 2 illustrates a front view of a portion of an engine showing various engine components and sensors.

FIG. 1 illustrates a portion of an automobile engine 2 including a variable valve timing system. The engine 2 includes a bank 10 of cylinders. The bank 10 of cylinders is shown with three cylinders as part of a six cylinder engine, but can include any number of cylinders. The engine 2 further includes an exhaust manifold 12, which allows exhaust gas to exit the cylinders for treatment by an exhaust system (not shown). An oxygen ($O_2$) sensor 14 is included within the exhaust manifold 12. The sensor 14 indicates the presence or lack of oxygen in the gas exhausted by the engine. The sensor's 14 indication tells whether the engine is running rich (i.e., too little air for the amount of fuel) or lean (i.e., too much air for the amount of fuel). The sensor produces a voltage signal (VS), which is supplied to the ECU 20 (FIG. 2). It should be appreciated that different types of $O_2$ sensors 14 can be used.

The engine portion illustrated in FIG. 1 also illustrates an intake cam phaser 18 and an exhaust cam phaser 16. Each cam phaser 16, 18 allows the ECU to modify the rotational position of the respective cam shaft relative to the crank shaft, allowing the opening and closing of the intake and exhaust valves to be varied, which changes the air flow characteristics of the engine 2. One function of the ECU 20 (FIG. 2) is to act as a feedback controller, utilizing a proportional-integral-derivative (PID) method, to provide a predetermined combustion level. Using data from the sensor 14, along with data from the intake cam sensor 22 (FIG. 2), exhaust cam sensor 24 (FIG. 2), and crank shaft position sensor 26 (FIG. 2) the ECU can manipulate the phasers 16, 18 to change the engine's air flow characteristics. In addition to the variable valve timing system the ECU controls other systems (not shown) to provide a predetermined combustion level. While both intake and exhaust cam phasers 16, 18 are shown, the method disclosed herein does not require both and is applicable to engines with a variety of variable valve timing systems.

FIG. 2 illustrates a front view of a portion of the engine 2. A timing drive chain/belt 32 wraps around a crank shaft pulley 30, an intake cam shaft 36, and an exhaust cam shaft 34. A tensioner 36 controls the tension on the timing drive chain/belt 32. An intake cam sensor 22, exhaust cam sensor 24, and crank shaft position sensor 26 are electrically connected to and provide information to the ECU 20. The sensors 22, 24 and 26 are typically Hall Effect sensors, but other sensors such as magnetic, magneto resistive, optical, or inductive sensors can be utilized.

The ECU 20 is a microprocessor-based controller, which is configured to control numerous engine functions. These functions include, but are not limited to, variable valve timing, fuel injection, ignition timing, and idle speed. The ECU 20 controls these functions by gathering data from various sensors placed throughout the engine and vehicle, performing calculations based on processes that are programmed into the ECU, and sending the appropriate control signals to the various engine systems. The advantages described herein are realized by programming the ECU to perform a process of setting a control parameter (e.g., mechanical-electrical confidence bit) as discussed relative to FIGS. 3 and 4 below.

The methods disclosed herein are carried out by computer instructions (i.e., firmware or software) stored within an ECU programmed to perform the disclosed series of operations.

These programmed ECUs are incorporated into a vehicle during the manufacturing process. In one embodiment the ECU is configured to carry out the method automatically at a predefined time. The predefined time can be when the engine is started for the first time during the vehicle manufacturing process, after the vehicle has traveled a specific number of miles, after the engine has run for a specific number of cycles, or after the engine has run for a specific amount of time. In an alternate embodiment, the ECU is configured to carry out the method when instructed to do so by an operator.

Figure 3:
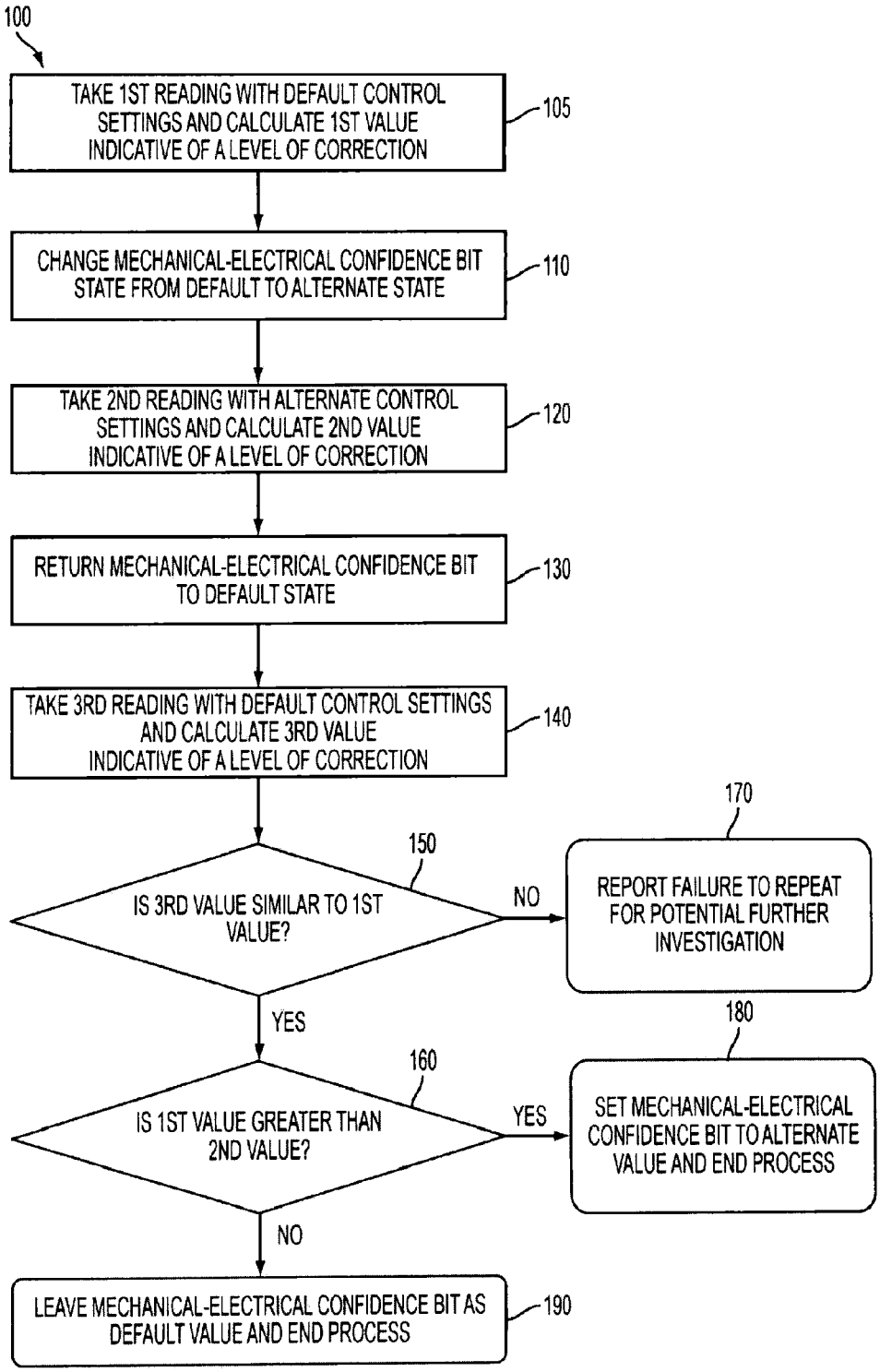
FIG. 3 is a flowchart illustrating a method in accordance with the present disclosure.

FIG. 3 is a flowchart illustrating a method 100 of setting a control parameter in accordance with the disclosed embodiments. In the illustrated example the control parameter is the mechanical-electrical confidence bit described above. At step 105, the ECU 20 takes a first reading of data from the $O_2$ sensor 14, and calculates a first value, known as an $O_2$ factor. This first reading and calculation are performed with the mechanical-electrical confidence bit set to the default state that was determined from previous dynamometer testing of a representative engine or small sample set of engines. During step 105, the ECU gathers data from the $O_2$ sensor 14 for a predefined number of engine cycles known as a sampling period. During the sampling period, the ECU 20 continues to function as a PID controller to provide a predetermined combustion level, as discussed previously. The $O_2$ factor is indicative of the level of correction required by the ECU to provide the predetermined combustion level. The larger the $O_2$ factor, the larger the correction required by the ECU to maintain the predetermined combustion level.

At step 110, the state of the mechanical-electrical confidence bit is changed from the default state to an alternate state in order to gather data for comparison. At step 120, a second reading of data from the $O_2$ sensor 14 is taken and a second value is calculated. Just like step 105, the ECU 20 gathers data from the $O_2$ sensor 14 for a second predefined number of engine cycles and then calculates a second value for the $O_2$ factor. This second value for the $O_2$ factor is indicative of the level of correction required by the ECU to provide the predetermined combustion level with the mechanical-electrical confidence bit in the alternate state. By changing the state of the mechanical-electrical confidence bit, the process 100 is able to measure performance of the controller under both possible states of the mechanical-electrical confidence bit to determine the best setting.

At step 130, the state of the mechanical-electrical confidence bit is returned to the original default state. At step 140, a third reading is taken and a third value of the $O_2$ factor is calculated. Step 140 is substantially similar to step 105 and therefore should produce similar results. At step 150, the third value is compared to the first value. If the two values are not the same, within a predefined allowable variation, the process 100 continues at step 170 where a "failure to repeat" condition is reported and the process 100 is ended. This error indicates that something caused the ECU 20 or the engine 2 to function differently although the same state of the mechanical-electrical confidence bit was used. When the third value is not generally the same as the first value, the integrity of the test is in doubt and it is not possible to determine which state of the mechanical-electrical confidence bit is more appropriate for the specific engine without further testing. When the "failure to repeat" condition occurs, the method 100 may be restarted or the engine can be flagged for further testing to be completed at another time.

If the third value is within the predefined allowable variation of the first value (step 150) the method 100 continues at step 160, where the first value is compared to the second value. This comparison is used to determine which state of the mechanical-electrical confidence bit required less correction by the ECU to maintain the predetermined combustion level. It is also possible to compare the second value to the third value or to mathematically combine the first and third values and compare the mathematical combination to the second value, if desired. The specific value compared is not important so long as the values compared are associated with different states of the mechanical-electrical confidence bit.

If the first value is greater than the second value (step 160), the process 100 continues at step 180 where the mechanical-electrical confidence bit is set to the alternate state and the process 100 is ended. In this instance, the alternate state of the mechanical-electrical confidence bit represents a better assumption relative to the particular engine being tested and setting the mechanical-electrical confidence bit to the alternate state will allow the ECU 20 to maintain the predetermined combustion level with minimal effort.

If the first value is less than or equal to the second value (step 160), the process 100 continues at step 190 where the mechanical-electrical confidence bit is left in the default state and the process 100 is ended. In this instance, the engine under test is behaving similarly to the sample engine that was tested on the dynamometer and the default state of the mechanical-electrical confidence bit is the appropriate state for this particular engine.

It is important to minimize the level of correction required by the ECU as doing so results in more responsive control of engine functions. Another way of thinking about the level of correction is to consider how much the ECU must do to create a predetermined combustion level in the engine. The ECU having the appropriate mechanical-electrical confidence bit state results in more accurate air flow modeling by the ECU, which in turn improves response time and engine performance while decreasing emissions. If the appropriate mechanical-electrical confidence bit state is not set, the ECU will take longer to bring the engine to the predetermined combustion level. Increased levels of ECU correction may even render the ECU incapable of reaching the predetermined combustion level when engine conditions are changing rapidly (i.e., during shifting, acceleration, deceleration, etc.). Additionally, increased ECU operation can cause increased movement of various control elements, resulting in unnecessary wear and shorter component life.

Figure 4:
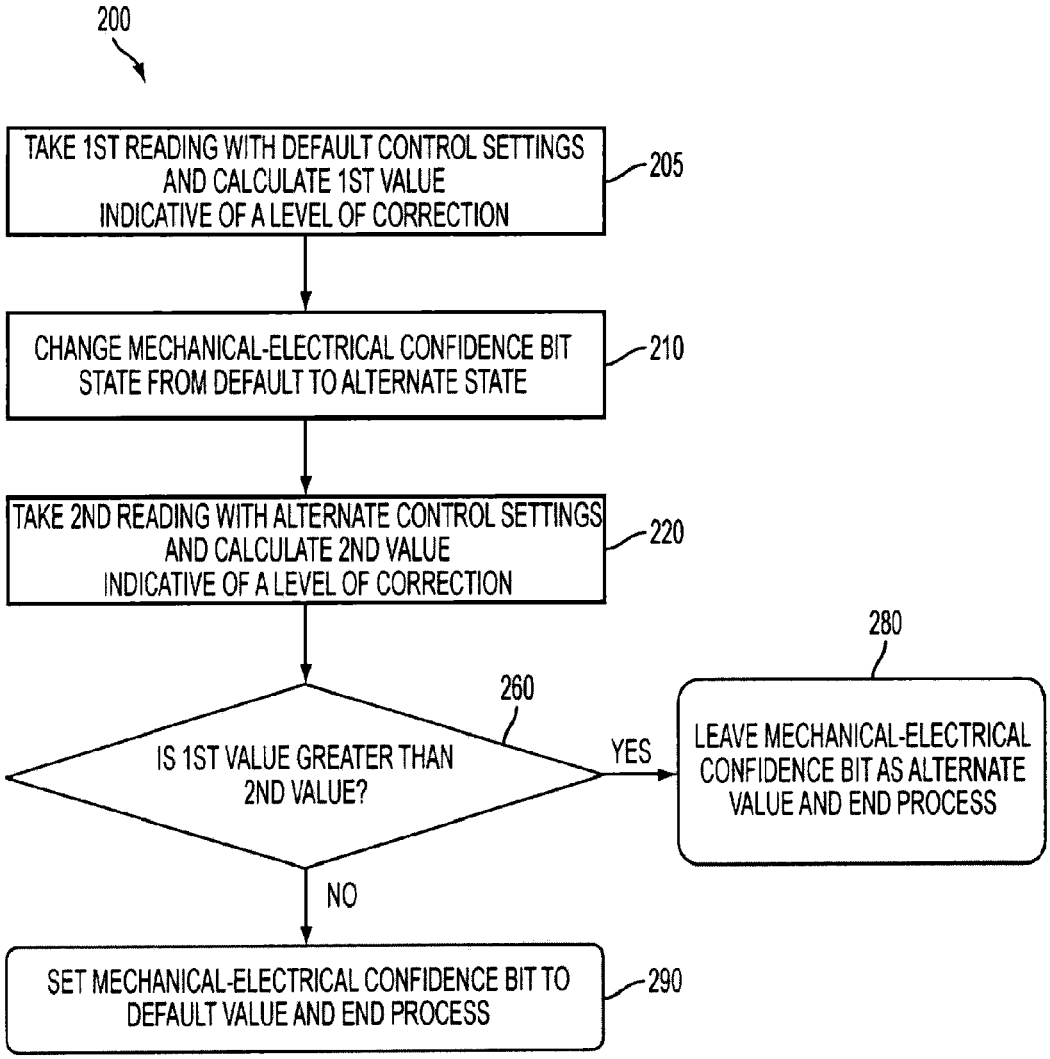
FIG. 4 is a flowchart illustrating another method in accordance with the present disclosure.

FIG. 4 shows another method 200 in accordance with a different embodiment. The method is substantially the same as that shown in FIG. 3 except that the repeatability test (i.e. steps 130, 140, 150, and 170) are removed.

At step 205, the ECU 20 takes a first reading of data from the $O_2$ sensor 14, and calculates a first value of the $O_2$ factor. This first reading and calculation are performed with the mechanical-electrical confidence bit set to the default state that was determined from previous dynamometer testing of a representative engine or small sample set of engines.

At step 210, the state of the mechanical-electrical confidence bit is changed from the default state to an alternate state in order to gather data for comparison. At step 220, a second reading of data from the $O_2$ sensor 14 is taken and a second value is calculated. Just like step 205, the ECU 20 gathers data from the $O_2$ sensor 14 for a second predefined number of engine cycles and then calculates a second value for the $O_2$ factor. This second value for the $O_2$ factor is indicative of the level of correction required by the ECU to provide the predetermined combustion level with the mechanical-electrical confidence bit in the alternate state. By changing the state of the mechanical-electrical confidence bit, the process 200 is able to measure performance of the controller under both possible states of the mechanical-electrical confidence bit to verify the best setting.

At step 260 the first value is compared to the second value. This comparison is used to determine which state of the mechanical-electrical confidence bit required less operation by the ECU to maintain the predetermined combustion level.

If the first value is greater than the second value (step 260), the process 200 continues at step 280 where the mechanical-electrical confidence bit is left in the alternate state (from step 220) and the process is ended. In this instance, the alternate state of the mechanical-electrical confidence bit represents a better assumption relative to the particular engine being tested and setting the mechanical-electrical confidence bit to the alternate state will allow the ECU 20 to maintain the predetermined combustion level with minimal correction.

If the first value is less than or equal to the second value (step 260), the process 200 continues at step 290 where the mechanical-electrical confidence bit is reset to the default state and the process 200 is ended. In this instance, the engine under test is behaving similarly to the sample engine that was tested on the dynamometer and the default state of the mechanical-electrical confidence bit is the appropriate state for this particular engine.

The methods 100, 200 can be performed at anytime, but it is anticipated that they would be performed when an engine is started for the first time as part of testing a newly manufactured vehicle, prior to being shipped to a dealership or sold to an end user. The methods 100, 200, however, are not limited to this particular schedule and may be performed at other times deemed appropriate. For instance, the best results may be achieved by performing the disclosed methods after a vehicle has traveled a predetermined number of miles or after an engine has run for a predetermined amount of time. It is also possible to configure the ECU to perform the method at any time when instructed to do so by an operator, such as a service technician.

What is claimed is:

1. A method of setting a control parameter in an automobile engine, said method comprising:

inputting into an engine control unit a first set of data from a sensor while the control parameter is set to a default state;

calculating a first value, based on the first set of data, indicative of a first level of correction required by the engine control unit to maintain a predetermined combustion level;

changing the control parameter from the default state to an alternate state;

inputting into the engine control unit a second set of data from the sensor;

calculating a second value, based on the second set of data, indicative of a second level of correction required by the engine control unit to maintain the predetermined combustion level;

comparing the first value to the second value; and setting the control parameter to either the default state or the alternate state based on the result of the comparison.

2. The method of claim 1, wherein:

if the first value is greater than the second value the control parameter is set to the alternate state; and if the first value is less than or equal to the second value the control parameter is set to the default state.

3. The method of claim 1, wherein the sensor is an oxygen sensor.

4. The method of claim 1, wherein the steps of inputting the first and second sets of data from the sensor further comprise inputting data from the sensor over a predefined sampling period.

5. The method of claim 1, wherein the control parameter can have one of two states, a first state indicating confidence in an electrical system and providing compensation for mechanical errors, and a second state indicating confidence in a mechanical system and providing compensation for electrical errors.

6. The method of claim 1, wherein the default state of the control parameter is determined by dynamometer testing of either an individual engine or a sample of representative engines.

7. The method of claim 1, wherein the method is performed when the automobile engine is started for the first time.

8. The method of claim 1, wherein the method is performed after an automobile containing the automobile engine has traveled a predetermined number of miles.

9. The method of claim 1, wherein the engine control unit is configured to model air flow through the engine based on the state of the control parameter.

10. The method of claim 1, wherein the engine control unit is part of an automobile engine comprising:

a plurality of cylinders;

an exhaust manifold connected to the plurality of cylinders;

at least one oxygen sensor located in the exhaust manifold;

a variable valve timing system for controlling airflow through the engine.

11. The method of claim 10, wherein the engine control unit is configured to receive data from the at least one oxygen sensor and to control the variable valve timing system to maintain the predetermined combustion level.

12. A method of setting a control parameter in an automobile engine, said method comprising:

inputting into an engine control unit a first set of data from a sensor while the control parameter is set to a default state;

calculating a first value, based on the first set of data, indicative of a first level of correction required by the engine control unit to maintain a predetermined combustion level;

changing the control parameter from the default state to an alternate state;

inputting into the engine control unit a second set of data from the sensor;

calculating a second value, based on the second set of data, indicative of a second level of correction required by the engine control unit to maintain the predetermined combustion level;

resetting the control parameter to the default state;

inputting into the engine control unit a third set of data from the sensor;

calculating a third value, based on the third set of data, indicative of a third level of correction required by the engine control unit to maintain the predetermined combustion level;

comparing the first value to the third value;

if the first value is not within a predefined allowable variation of the third value, reporting a failure; and if the first value is within a predefined allowable variation of the third value, setting the control parameter to the alternate state if the first value is greater than the second value, or setting the control parameter to the default state if the first value is less than or equal to the second value.

13. The method of claim 12, wherein the sensor is an oxygen sensor.

14. The method of claim 12, wherein the steps of inputting the first, second, and third sets of data from the sensor further comprise inputting the data from the sensor over a predefined sampling period.

15. The method of claim 12, wherein the method is performed when the automobile engine is started for the first time.

16. The method of claim 12, wherein the method is performed after an automobile containing the automobile engine has traveled a predetermined number of miles.

17. The method of claim 12, wherein the engine control unit is configured to model air flow through the engine based on the state of the control parameter.

18. The method of claim 12, wherein the engine control unit is part of an automobile engine comprising:

a plurality of cylinders;

an exhaust manifold connected to the plurality of cylinders;

at least one oxygen sensor located in the exhaust manifold;

a variable valve timing system for controlling airflow through the engine.

19. The method of claim 18, wherein the engine control unit is configured to receive data from the at least one oxygen sensor and to control the variable valve timing system to maintain the predetermined combustion level.

* * * * *